US011554400B2

(12) United States Patent
Fitzner et al.

(10) Patent No.: US 11,554,400 B2
(45) Date of Patent: Jan. 17, 2023

(54) ARMOURED CABLE AND ITS MANUFACTURE

(71) Applicants: Marc Fitzner, Mississauga (CA); Paul Mcmillen, Bolton (CA)

(72) Inventors: Marc Fitzner, Mississauga (CA); Paul Mcmillen, Bolton (CA)

( * ) Notice: Subject to any disclaimer, the term of this patent is extended or adjusted under 35 U.S.C. 154(b) by 428 days.

(21) Appl. No.: 16/755,288

(22) PCT Filed: Oct. 17, 2017

(86) PCT No.: PCT/CA2017/051233

§ 371 (c)(1),
(2) Date: Apr. 10, 2020

(87) PCT Pub. No.: WO2019/075542

PCT Pub. Date: Apr. 25, 2019

(65) Prior Publication Data

US 2021/0101196 A1 Apr. 8, 2021

(51) Int. Cl.

| | |
|---|---|
| ***F16L 11/16*** | (2006.01) |
| ***B21C 37/12*** | (2006.01) |
| ***D07B 1/08*** | (2006.01) |
| ***D07B 7/14*** | (2006.01) |

(52) U.S. Cl.

CPC ..... *B21C 37/121* (2013.01); *B21C 37/124* (2013.01); *B21C 37/126* (2013.01); *D07B 1/08* (2013.01); *D07B 7/14* (2013.01); *D07B 2201/2089* (2013.01)

(58) Field of Classification Search

CPC . F16L 11/05; F16L 11/16; F16L 11/24; B21C 37/22; B21C 37/26; B21C 37/121; B21C 37/124

USPC ..... 138/129, 130, 131, 134, 135, 121, 122

See application file for complete search history.

(56) References Cited

U.S. PATENT DOCUMENTS

| | | | | |
|---|---|---|---|---|
| 1,068,553 | A * | 7/1913 | Abell | F16L 11/16 138/135 |
| 2,191,690 | A * | 2/1940 | Witzenmann | F16L 11/16 138/122 |
| 4,783,980 | A | 11/1988 | Varga | |
| 9,440,273 | B2 | 9/2016 | Mcmillen | |
| 2002/0195157 | A1* | 12/2002 | Foti | F16L 11/16 138/135 |
| 2004/0216796 | A1* | 11/2004 | Fukui | F16L 11/24 138/144 |

(Continued)

FOREIGN PATENT DOCUMENTS

| | | | |
|---|---|---|---|
| CA | 2632644 | A1 | 6/2007 |

OTHER PUBLICATIONS

International Search Report for International Application No. PCT/CA2017/051233 dated Jun. 22, 2018.

*Primary Examiner* — Patrick F Brinson
(74) *Attorney, Agent, or Firm* — Dinsmore & Shohl LLP

(57) ABSTRACT

A product having a metal strip and a central longitudinal axis. The strip has two or more strip parts, each having a common radius of curvature defining a helix having an angle being offset from one another in the direction of the axis. A cross section of the strip parts causes them to be interlocked together throughout their lengths to define a flexible metal tube. The outside diameter of the tube is between ⅜" and 1⅜" and the helix angle of each strip part is between eight and thirty degrees.

6 Claims, 7 Drawing Sheets

(56) References Cited

U.S. PATENT DOCUMENTS

| | | | | |
|---|---|---|---|---|
| 2007/0245789 | A1* | 10/2007 | Zepp | B21C 37/121 72/49 |
| 2013/0319722 | A1* | 12/2013 | McMillen | B21C 37/20 72/135 |
| 2016/0003381 | A1* | 1/2016 | Király | B21C 37/124 138/134 |
| 2016/0225494 | A1 | 8/2016 | Harrington et al. | |

* cited by examiner

ARMOURED CABLE AND ITS MANUFACTURE

CROSS REFERENCE TO RELATED APPLICATIONS

This application is the U.S. national stage of PCT/CA2017/051233 filed Oct. 17, 2017 which is hereby incorporated by reference in its entirety.

FIELD OF THE INVENTION

The invention relates to the field of metal clad and interlocked armoured cables and apparatus for the manufacture thereof.

BACKGROUND OF THE INVENTION

It is well known to wrap a single strip of metal around a cable to define a flexible tube that shields the cable. It is also known, in U.S. Pat. No. 9,440,273, incorporated herein by reference, to wrap two strips of metal around a cable to define a flexible metal tube that shields the cable; advantages of this approach include doubling rates of production at equivalent rates of rotation.

SUMMARY OF THE INVENTION

Forming one aspect of the invention is an improved product, the product being of the type having a metal strip and a central longitudinal axis, the strip being defined by two or more separate strip parts, the two or more strip parts each: having a common radius of curvature; defining a helix having an angle; being offset from one another in the direction of the axis; and having cross sections such that the strip parts are interlocked together throughout their lengths and such that the strip is interlocked with itself throughout its length to define a flexible metal tube.

The improvement comprises: the outside diameter of the tube being between ⅜" and 1⅜"; and the helix angle of each strip part being between 8 and 30 degrees.

According to another aspect of the invention, in respect of each strip part, the width can be about ⅜" and the helix angle is between 8 and 30 degree.

According to another aspect of the invention, the outside diameter of the tube can be between ⅝" and 1⅜" and, in respect of each strip part, the width can be about ½" and the helix angle can be between 10 and 22 degrees.

According to another aspect of the invention: the strip part can be aluminum and have a thickness between about 0.016" and about 0.040"; or the strip part can be galvanized steel and have a thickness between about 0.010" and about 0.035"

According to another aspect of the invention, the strip part has a profile substantially as shown in FIG. 10.

Forming another aspect of the invention is improved apparatus for use with two supplies of strip metal.

The apparatus is of the type: having, for each supply of strip metal, a pair of roll-forming dies and a tooling assembly the roll-forming dies for said each supply being adapted to: receive strip metal from said each supply; form a profile in the strip metal to product profiled strip metal; and deliver the profiled strip metal to the tooling assembly provided for said each supply;

the tooling assembly for said each supply being adapted to put a curl in the profiled strip metal to produce a helical strip;

the tooling assemblies and roll-forming dies being adapted such that: the axes of the helical strips are coincident; the helical strips are offset from one another along the axes; the helical strips are interlocked to one another throughout their lengths to define a helical element; and the helical element is interlocked with itself throughout its length to form a flexible tube, The improvement comprises: the apparatus being adapted to releasably receive, for each strip metal supply, a spool of strip metal, the spool of strip metal defining the strip metal supply in use.

According to another aspect of the invention: a chuck is provided for each strip metal supply, the chuck, in use, releasably receiving the spool provided for said each strip metal supply; each chuck has a central axis about which the chuck rotates and a central passage through which the central axis extends; the central axes of the chucks are coincident; and the tooling assemblies and roll-forming dies are mounted on a head which rotates in use such that the tube exits the apparatus without rotation.

According to another aspect of the invention, only one of the two supplies of strip metal passes through a chuck prior to delivery to the head.

According to another aspect of the invention: each supply of strip metal is delivered to the head at a fixed angle; and the supplies are strip metal are delivered to the head 180 apart from one another with reference to the rotation axis of the head.

Forming yet another aspect of the invention is improved apparatus for use with a coil of strip metal, the apparatus being of the type having: a spindle that rotates the coil in a driving direction and about an axis in use; a sun gear rotating in use about the axis; planetary gears driven by the sun gear; a pair of rollers driven by the planetary gears, the rollers drawing strip metal from the coil.

This improvement comprises: a gear arrangement interposed between the sun gear and the planetary gears such that rotation of the sun gear relative to the spindle in the driving direction causes strip metal to be drawn through the feeders.

Other advantages, features and characteristics of the present invention will become apparent upon a review of the detailed description with reference to the appended drawings, the latter being briefly described hereinafter.

DETAILED DESCRIPTION

As indicated, the invention relates to improvements in the field of metal clad and interlocked armoured cables and in the manufacture thereof.

Figure 1:
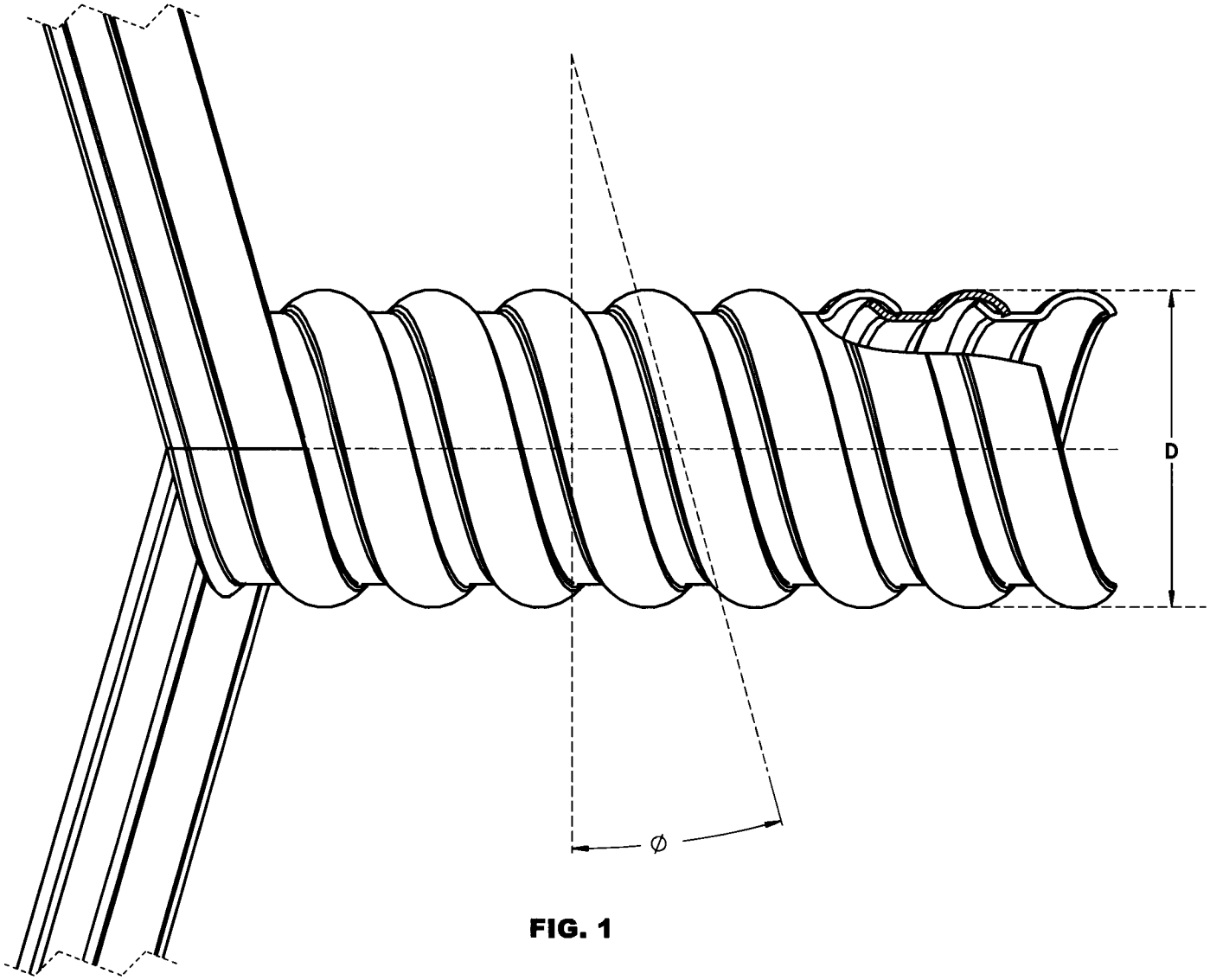
FIG. 1 is a side view of a flexible tube according to an exemplary embodiment of the invention.
Figure 2:
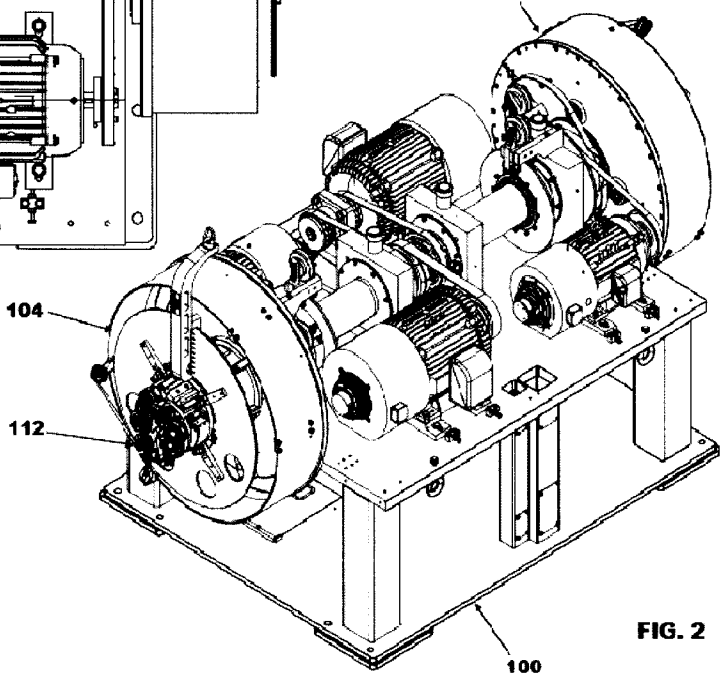
FIG. 2 is a perspective view of apparatus for producing flexible tube that forms another aspect of the invention.
Figure 3:
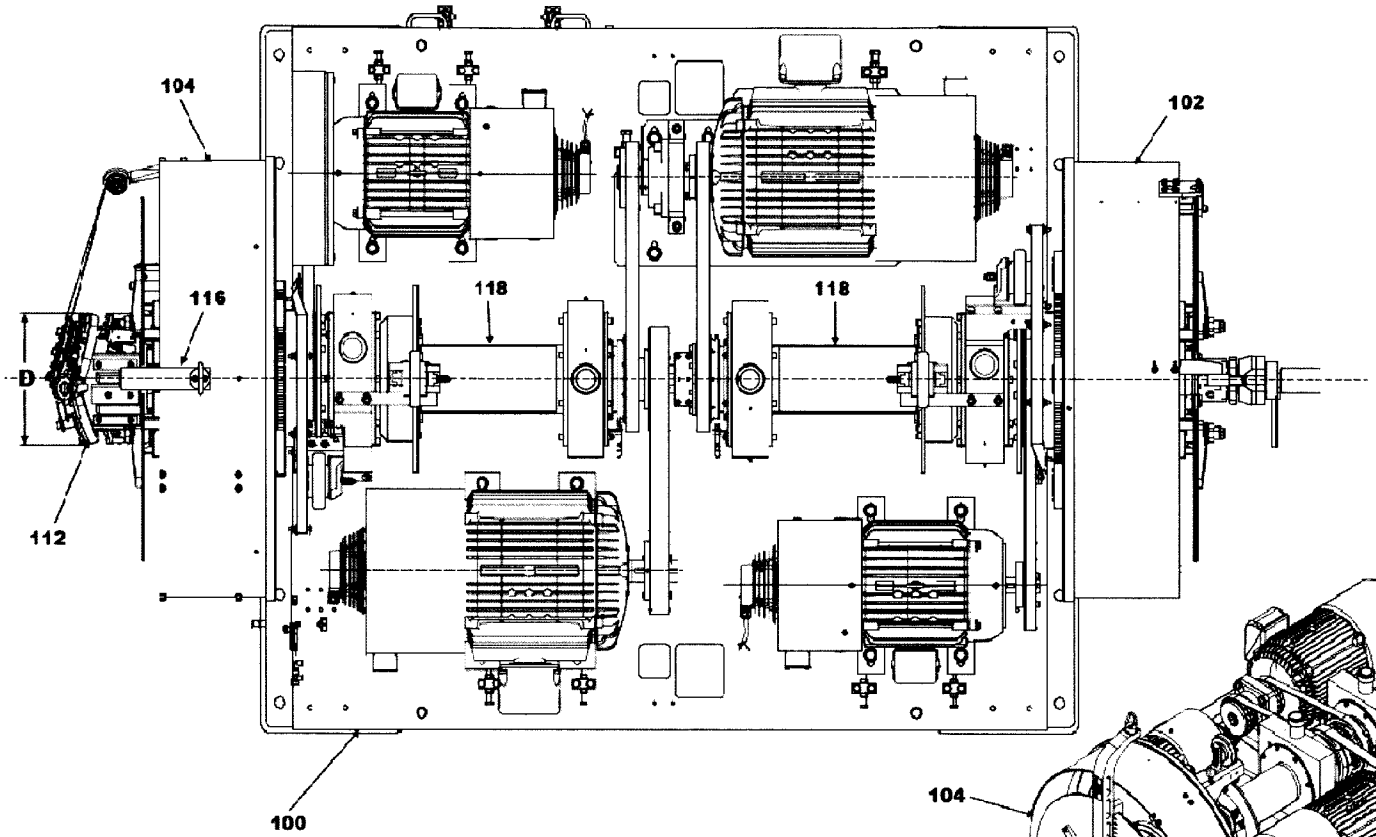
FIG. 3 is a plan view of the structure of FIG. 2.
Figure 4:
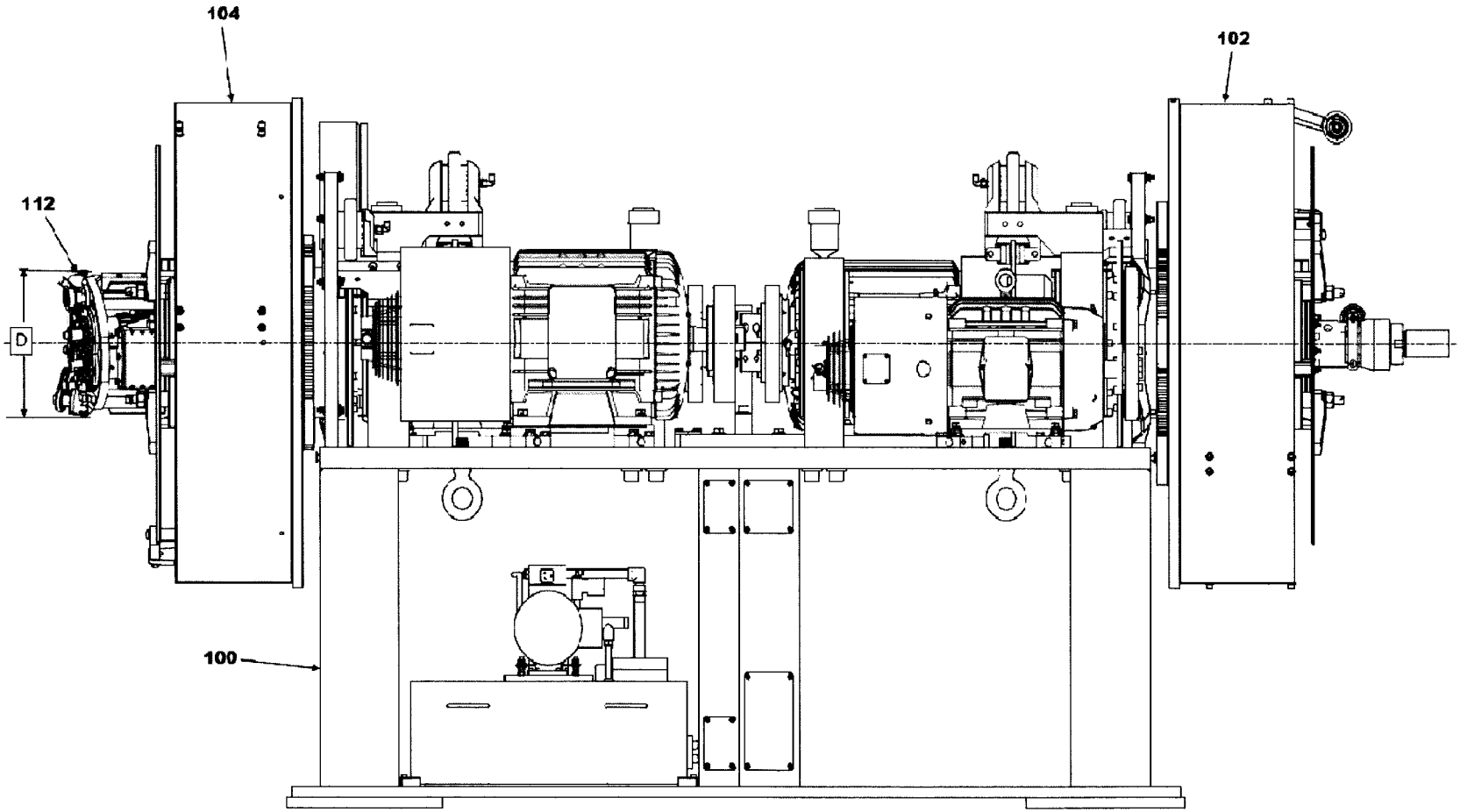
FIG. 4 is a side view of the structure of FIG. 2.
Figure 5:
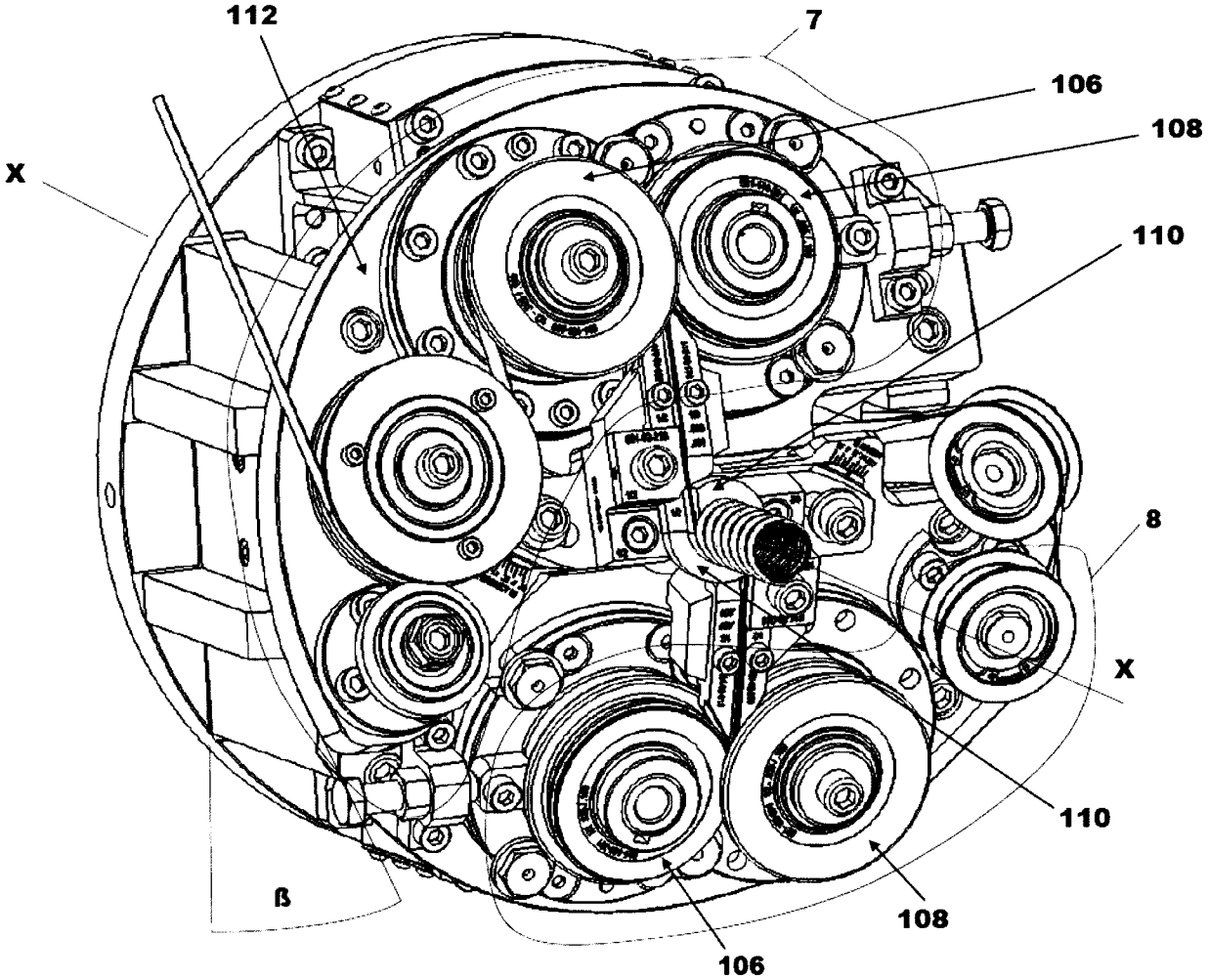
FIG. 5 is an enlarged perspective of the structure of encircled area 5 of FIG. 2.
Figure 6:
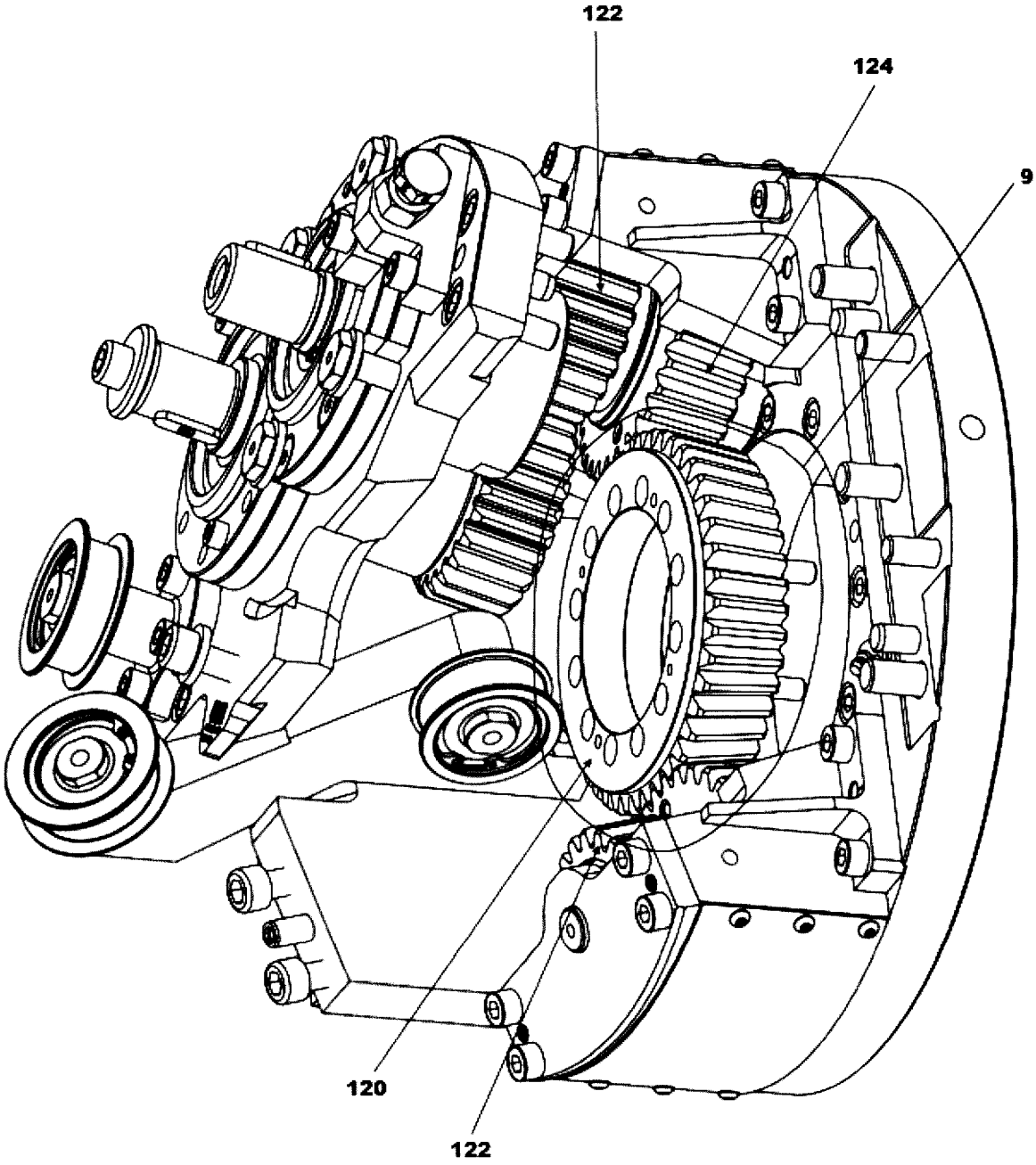
FIG. 6 is a view of a portion of the structure of FIG. 5.
Figure 7:
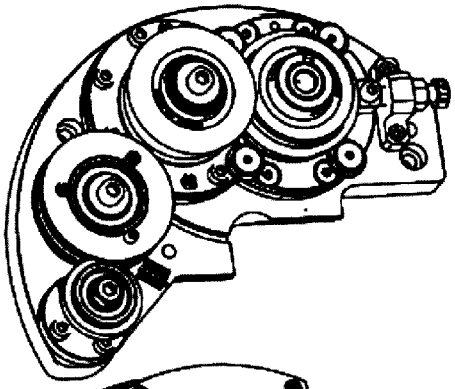
FIG. 7 is a view of the structure of encircled area 7 of FIG. 5.
Figure 9:
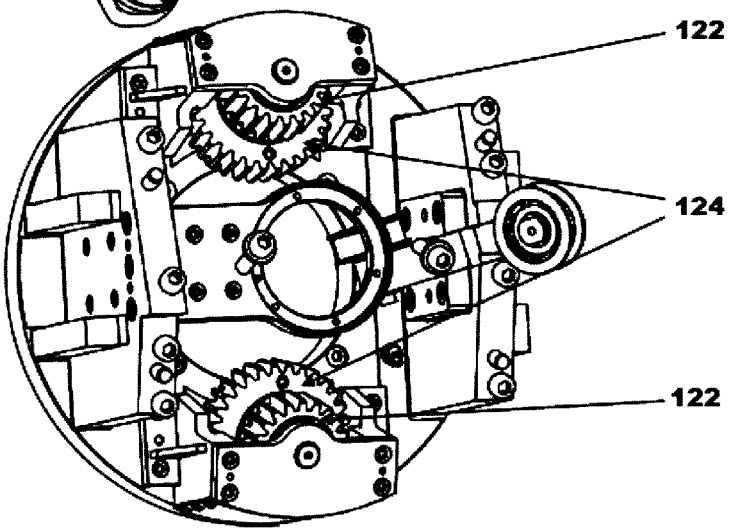
FIG. 9 is a view of the structure of FIG. 5 with the structure of encircled 9 of FIG. 6 removed, the structure of FIG. 8 removed and the roll-forming dies of the structure of FIG. 7 removed.
Figure 8:
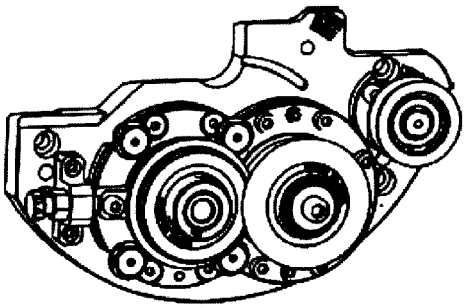
FIG. 8 is a view of the structure of encircled area 8 of FIG. 5.

FIG. 1 shows armoured cable 20 that represents an exemplary embodiment of the invention. This cable is visually similar to the armoured cable produced, for example, according to U.S. Pat. No. 9,440,273, incorporated herein by reference, but differs in that: the outside diameter OD of the tube is 0.44" and the helix angle Ø of each strip part [⅜" wide, 0.016" thick, nominal] is 26°. This cable, surprisingly, was capable of passing both 150 pound (UL 1569) for metal clad (MC) cables and 300 pound pull tests (UL4, CAS C22.2 No. 51) for armored cables (AC).

It is speculated that the strength of the cable derives from the profile utilized in the roll-forming dies utilized.

Figure 10:
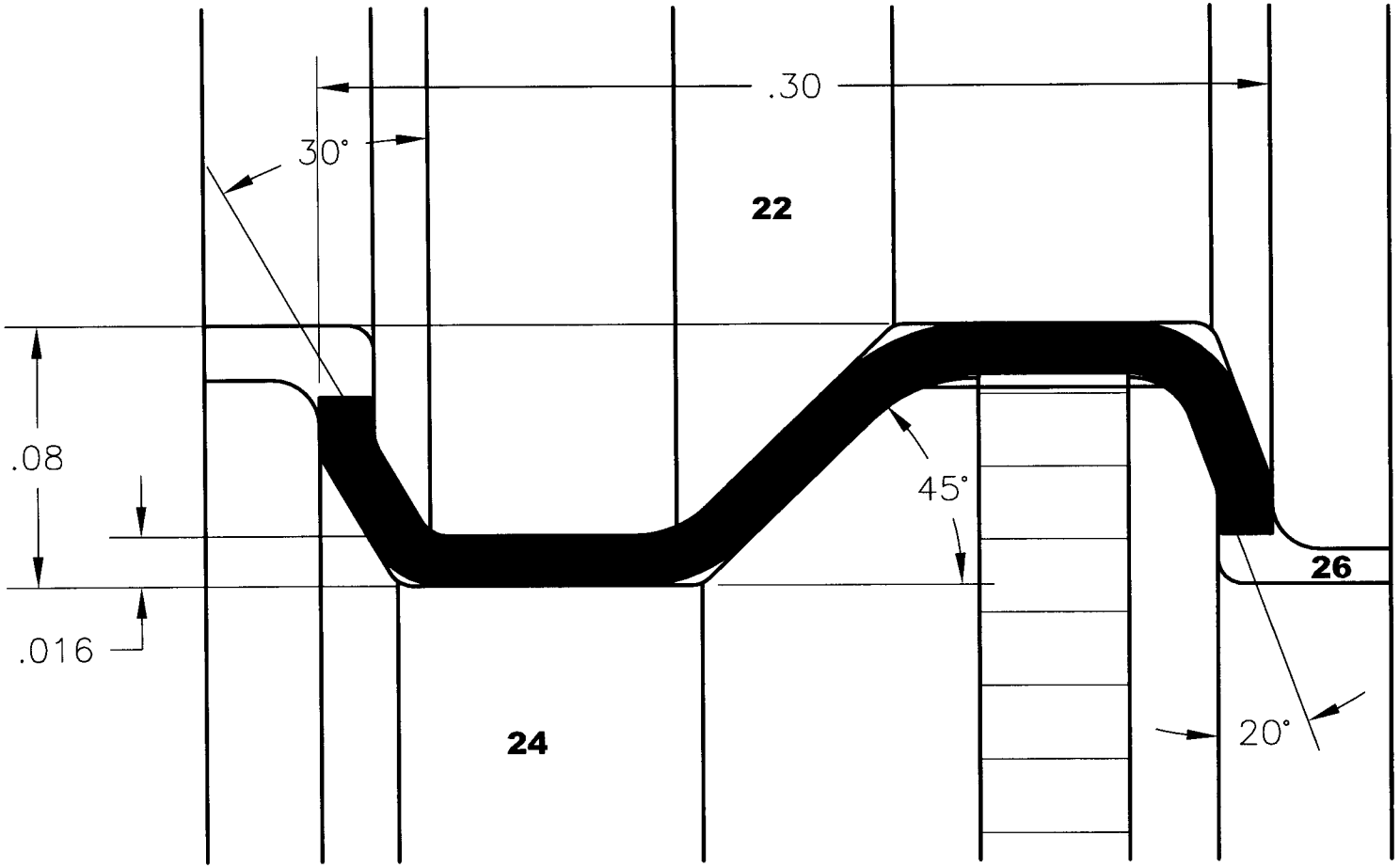
FIG. 10 is a view of the profile formed by the roll forming dies.

FIG. 10 shows the profiles of the dies 22, 24 utilized and the cavity 26 defined therebetween for the production of the profiled 0.16" strip; the dark thick line shows the theoretical shape of the strip material produced by passage between the dies.

Persons of ordinary skill in the art, by routinely resizing the lengths of the horizontal portions of this profile and the spacing between the roll-forming dies, can produce armour cable meeting the 300 pound pull test as follows:

strip metal supply width: ⅜"-½"

strip metal types: aluminum, having a thickness between about 0.016" and 0.040"

galvanized steel, having a thickness between about 0.010" and 0.035"

helix angle between 8 and 30 degrees outside diameter of the tube ⅜" and 1⅜"

When using ⅜" strip, the outside diameter of the tube will be ⅜" and 1⅜" and the helix angle will be between 8 and 30 degrees. When using ½" strip, the outside of the tube will be between ⅝" and 1⅜" and the helix angle is between 10 and 22 degrees.

FIGS. 2-9 show apparatus 100 for producing the flexible tube according to another exemplary embodiment of the invention.

This apparatus 100 bears some similarity to the apparatus taught in U.S. Pat. No. 9,440,273, incorporated herein by reference, in that it is of the type for use with two supplies of strip metal 102, 104 and is further of the type having for each supply of strip metal, a pair of roll-forming dies 106, 108 and a tooling 110 assembly the roll-forming dies for said each supply being adapted to: receive strip metal from said each supply; form a profile in the strip metal to product profiled strip metal; and deliver the profiled strip metal to the tooling assembly provided for said each supply;

the tooling assembly for said each supply being adapted to put a curl in the profiled strip metal to produce a helical strip;

the tooling assemblies and roll-forming dies being adapted such that: the axes of the helical strips are coincident; the helical strips are offset from one another along the axes; the helical strips are interlocked to one another throughout their lengths to define a helical element; and the helical element is interlocked with itself throughout its length to form a flexible tube;

the tooling assemblies and roll-forming dies are mounted on a head 112 which rotates in use about a rotation axis X such that the tube exits the apparatus without rotation; and the supplies of strip metal are delivered to the head 112 are 180° apart from one another with reference to the rotation axis of the head.

However, this apparatus differs materially in that:

it includes a pair of chucks 114, 116 provided one for each strip metal supply, each chuck:

in use, releasably receiving a spool of strip metal which defines the supply of strip metal for which said each chuck is provided;

having a central axis about which the chuck rotates and a central passage through which the central axis extends, the central axes of the chucks being coincident with the rotation axis of the head;

only one 102 of the two supplies of strip metal passes through a chuck prior to delivery to the head each supply of strip metal is delivered to the head at a fixed angle β of 16° the head 112 has a diameter D of less than 16"

Persons of ordinary skill will immediately appreciate numerous advantages of such device, including but not limited to:

the ability to use readily available coils of strip material; and the ability to produce popular sizes of armoured cable at relatively high rates of production within a relatively small footprint, relatively low labor requirement and at relatively low capital cost in comparison to conventional single strip machinery.

Yet another difference between this apparatus and that taught in U.S. Pat. No. 9,440,273 is that it includes, in combination:

a spindle 118 that rotates a coil in a driving direction and about an axis in use;

a sun gear 120 rotating in use about the axis;

planetary gears 122 driven by the sun gear and driving the dies 106, 108 a gear arrangement 124 is interposed between the sun gear and the planetary gears such that rotation of the sun gear relative to the spindle in the driving direction causes strip metal to be drawn through the feeders.

Without intending to be bound by theory, the gear arrangement 124 is believed to overcome the natural tendency of the spindle rotation to counter the rotation of the feed rollers.

Whereas a single embodiment of the apparatus is illustrated, it will be evident that variations are possible. Accordingly, the invention should be understood to be limited only by the accompanying claims, purposively construed.

The invention claimed is:

1. An improved product having a metal strip and a central longitudinal axis, the strip being defined by two or more separate strip parts, the two or more strip parts each:

having a common radius of curvature;

defining a helix having an angle;

being offset from one another in the direction of the axis; and having cross sections such that the strip parts are interlocked together throughout their lengths and such that the strip is interlocked with itself throughout its length to define a flexible metal tube, the improvement comprising:

an outside diameter of the tube being of a range between ⅜" and 1⅜"; and the helix angle of each strip part being of a range between 8 and 30 degrees.

2. The product according to claim 1, each strip part further comprising a width of ⅜".

3. The product according to claim 1, further comprising the outside diameter range of the tube being of a subset range between ⅝" and 1⅜" and, in respect of each strip part, a width of ½" and the helix angle range further including a subset range of between 10 and 22 degrees.

4. The product of claim 1, further comprising:

the strip parts are aluminum and have a thickness between 0.016" and 0.040".

5. The product of claim 1, further comprising the strip parts being curled to form a helical strip.

6. The product of claim 1, wherein:

the strip parts are galvanized steel and have a thickness between 0.010" and 0.035".

* * * * *